US005143370A

United States Patent [19]

Richards

[11] Patent Number: 5,143,370

[45] Date of Patent: Sep. 1, 1992

[54] BALL RACKET

[75] Inventor: Loren L. Richards, Wayzata, Minn.

[73] Assignee: Rammer, Inc., St. Paul, Minn.

[21] Appl. No.: 817,058

[22] Filed: Jan. 6, 1992

[51] Int. Cl.[5] ..... A63B 69/40

[52] U.S. Cl. ..... 273/26 B; 273/73 D

[58] Field of Search ..... 273/73 D, 73 L, 73 R, 273/67 R, 26 B, 26 A

[56] References Cited

U.S. PATENT DOCUMENTS

| | | | |
|---|---|---|---|
| 3,582,073 | 1/1971 | Melnick | 273/73 D |
| 3,647,211 | 3/1972 | Doessel | 273/73 D |
| 3,801,099 | 4/1974 | Lair | 273/73 D |
| 4,185,822 | 1/1980 | Li | 273/73 D |
| 4,566,695 | 1/1986 | Melby | 273/73 D |
| 4,880,234 | 11/1989 | Salisbury | 273/73 L |
| 5,009,422 | 4/1991 | Soong | 273/73 D |

*Primary Examiner*—Theatrice Brown
*Attorney, Agent, or Firm*—Haugen and Nikolai

[57] ABSTRACT

A sports racket, especially designed for hitting baseballs and softballs, comprises a generally rectangular frame defining a central opening with a net disposed within the central opening. The frame includes an integrally formed flange extending perpendicular to the plane of the frame and surrounding the central opening. A plurality of slits are formed at regular spaced intervals along the periphery of the flange, and disposed outwardly of each of the slits is a post or pin. Elastic (rubber) straps extend through the slits and loop around the perimeter strands of the net and their free ends are affixed to the post by having the post penetrate through aligned apertures formed in the ends of the rubber strips.

9 Claims, 1 Drawing Sheet

BALL RACKET

BACKGROUND OF THE INVENTION

Field of the Invention:

This invention relates generally to sports equipment, and more particularly to the novel design of a racket specially designed for hitting baseballs and softballs during fielding practice.

II. Discussion of the Prior Art:

It is well known that baseball and softball are highly popular sports for young boys and girls throughout the world. It is estimated that the Little League program involves more than 175,000 teams in the United States alone. Team coaches are often parents of one or more of the team players and it is an understatement to say that many are not particularly competent at throwing a ball in the air and hitting it with a standard baseball or softball bat during the course of fielding practice. They naturally suffer some degree of embarrassment after several tries when they either miss the ball completely or dribble a grounder a few feet in front of them. Cat calls or comments from the youngsters may prove hard to take.

To accommodate those individuals who are not particularly skilled at tossing a ball in the air and hitting it to outfielders, I have devised a racket which allows this to be done with considerable accuracy after only a very few tries. By simply dropping the ball while swinging the racket underhand with a desired force, baseballs and softballs can be lofted into the air along a desired arc to the players who are attempting to improve their ball catching techniques.

It is accordingly a principal object of the present invention to provide an improved racket, especially designed to hit objects, such as standard baseballs and softballs.

Another object of the invention is to provide a racket of the type having a frame supporting a net which is held in tension by a plurality of elastic bands whereby the energy of the impact between the ball and the net is effectively transferred to the ball.

Yet another object of the invention is to provide a ball racket of the type described which is rugged in its construction and capable of holding up over long periods of use.

SUMMARY OF THE INVENTION

These and various other objects and advantages of the invention are achieved by providing a sports racket comprising a generally rectangular frame member having rounded corners where the frame defines a central opening also of a generally rectangular shape. Surrounding the central opening and formed integrally with the frame is a flange which extends perpendicular to the plane of the central opening. This flange includes a plurality of regularly spaced slits extending through it and which are parallel to the plane of the central opening. Disposed rearward of each of the slits is a corresponding plurality of posts which project perpendicularly to the rear face of the frame member.

A string net is centrally disposed within the central opening of the frame member and a plurality of elastic bands individually loop through the perimeter strands of the net and extend individually through the slits in the flange. The ends of the bands have small circular openings formed through the thickness thereof allowing the opposed free ends of the bands to fit over the posts.

Because of the manner in which the bands secure the net to the frame by passing through slits formed in the frame flange, upon striking a ball, pure tension forces are applied to the bands and there is no tendency for them to lift free of their connection posts upon such impact.

DESCRIPTION OF THE PREFERRED EMBODIMENT

Figure 1:
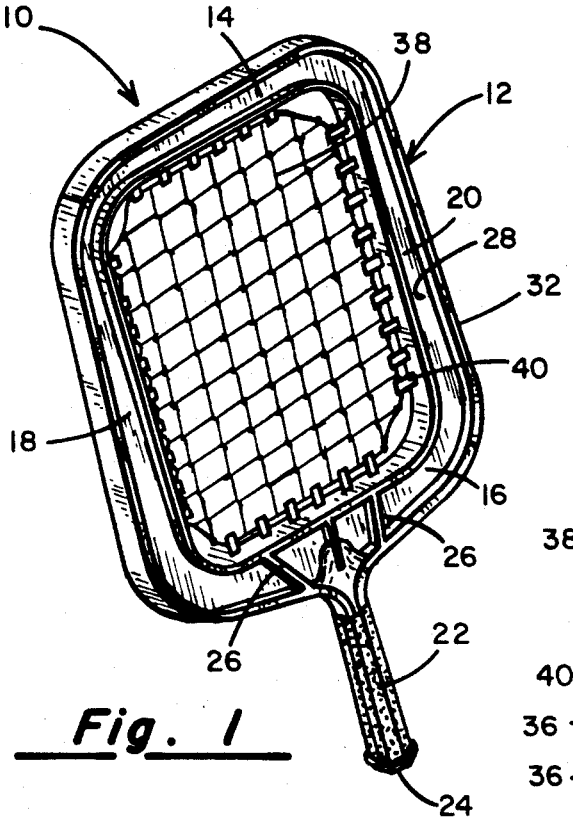
FIG. 1 is a perspective view of the ball racket of the present invention when observed from the front.

Referring to the drawings in which like numerals in the several views refer to corresponding parts, there is indicated generally by numeral 10 the ball racket of the present invention. It is seen to comprise a frame 12 which is preferably formed in a molding operation from a variety of thermoplastic materials and may be either glass or graphite carbon fiber reinforced for added strength. Desired colorants may also be added to the plastic for aesthetic purposes.

The frame 12 has a top 14, a bottom 16 and spaced-apart sides 18 and 20 and projecting outwardly from the plane of the frame along its bottom edge 16 is an integrally formed handle member 22. The handle 22 may be covered with a cork-like substance to facilitate the gripping thereof and preventing slipping when gripped in a perspiring palm. An enlargement 24 at the free end of the handle also serves to prevent the racket from slipping from the hand when stroking a ball.

To provide added strength to the frame at the point where the handle 22 joins to it, reinforcing ribs as at 26 achieve this result without appreciably increasing the overall weight of the racket.

Extending around the inner perimeter of the frame 12 is a perpendicularly projecting flange 28. The flange 28 is integrally molded to a central web 30 as is a second, outer flange 32 which forms the perimeter of the racket. The flange 32 has its outer edge curved at a predetermined radius primarily for aesthetic reasons.

Figure 3:
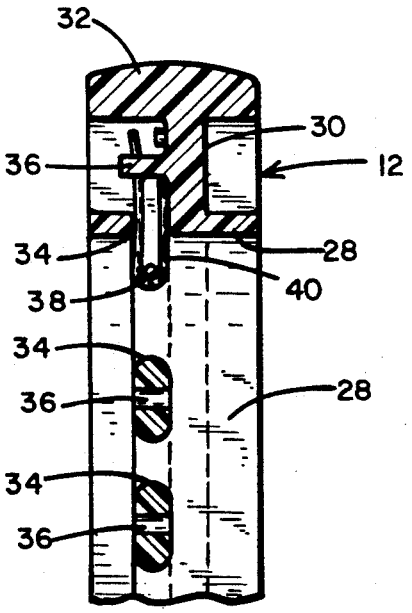
FIG. 3 is a cross-sectional view taken along the line 3—3 in FIG. 2.

With reference to FIG. 3, it can be seen that formed through the thickness dimension of the inner flange 28 are a plurality of short slits 34. Associated with each of the slits is a corresponding plurality of pins or posts 36 which project normally from the rear face of the web 30. They are positioned so as to be aligned with an associated slit. Again, it is preferable that the posts 36 be integrally molded with the frame and handle of the racket.

Figure 2:
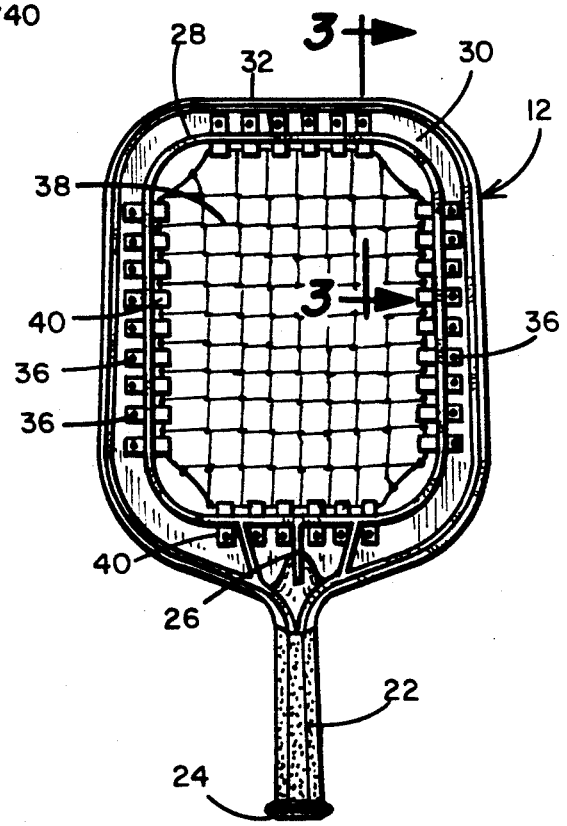
FIG. 2 is a rear view of the racket of FIG. 1.

As illustrated in FIGS. 1 and 2, disposed within the central opening of the frame 12 is a woven net 38, preferably formed from nylon cord in an open, woven grid pattern. The net 38 is held in place within the central opening of the frame by a plurality of elastic strips or bands 40. Each of the bands comprises a flat strip of either a natural rubber or a synthetic elastomeric material exhibiting good elastic properties. Each of the rubber strips has a hole or aperture formed through its thickness dimension at each end thereof. In assembling the net to the racket frame, the rubber strips are looped about the perimeter strands of the net 38 and then fed through the slits 34 formed through the flange 28 and then pushed over the posts 36 by passing the posts through the apertures formed in the ends of the strips.

When all of the plural strips or bands are so connected, the net 38 is maintained in tension. Furthermore, because the bands 40 extend through the slits 34 in the inner flange 28, when a heavy ball is struck with the racket, the bands are put in pure tension which does not permit them to pop free of their retaining posts.

OPERATION

In use, the batter grasps the handle 22 in one hand and as he releases the ball from his other hand, the racket is swung in an upward sweeping motion to contact the ball. Upon initially hitting the net, all of the bands 40 become more tensioned and the energy thereby stored in them is subsequently and immediately released to loft the ball skyward in a desired arc to the awaiting players. Because of the size of the racket, with very little practice, the user can usually cause the ball to strike centrally of the net which may be considered the "sweet-spot", i.e., the point of contact where maximum travel with a minimum of effort takes place.

If it is desired to hit grounders, the user may use a side arm stroke rather than an underhand stroke. Similarly, line drives may be hit as well.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A sports racket for striking a ball comprising:

(a) a generally rectangular frame member with rounded corners defining a central opening, a front face, a rear face and an integrally formed flange extending perpendicular to the plane of said central opening and surrounding said central opening, said flange including a plurality of regularly spaced slits extending parallel to said plane of said central opening and a corresponding plurality of posts disposed in alignment with said plurality of slits and projecting perpendicular to said rear face of said frame member;

(b) a string net having a perimeter strand and centrally disposed within said central opening of said frame member; and (c) a plurality of elastic bands individually looped through said perimeter strand of said sting net and extending individually through said slits in said flange, each of said bands having opposed ends with apertures formed therethrough for fitting about said posts.

2. The sports racket as in claim 1 and further including a second integrally formed flange extending about the outer perimeter of said frame member.

3. The sports racket as in claim 2 wherein said second flange has a rounded outer contour.

4. The sports racket as in claim 1 and further including a handle member affixed to one side of said generally rectangular frame and projecting perpendicularly thereto in a direction coplanar with said plane of said central opening.

5. The sports racket as in claim 1 wherein said handle is integrally formed with said frame member.

6. The sports racket as in claim 5 wherein said frame member and said handle are made of thermoplastic material.

7. The sports racket as in claim 6 wherein said thermoplastic is fiber reinforced.

8. The sports racket as in claim 1 wherein said string net comprises an open weave of nylon cords.

9. The sports racket as in claim 1 wherein said plurality of elastic bands maintain said string net in tension.

* * * * *

UNITED STATES PATENT AND TRADEMARK OFFICE

CERTIFICATE OF CORRECTION

PATENT NO. : 5,143,370

DATED : September 1, 1992

INVENTOR(S) : Loren L. Richards

It is certified that error appears in the above-identified patent and that said Letters Patent is hereby corrected as shown below:

Column 4, line 14, change "sting" to -- string --.

Signed and Sealed this

Nineteenth Day of October, 1993

*Attest:*

*Attesting Officer*

Bruce Lehman

BRUCE LEHMAN

*Commissioner of Patents and Trademarks*